US007051884B2

(12) United States Patent
Dick

(10) Patent No.: US 7,051,884 B2
(45) Date of Patent: May 30, 2006

(54) SYSTEM FOR INDUSTRIAL WORKSPACE ORGANIZATION

(75) Inventor: Spencer B. Dick, Portland, OR (US)

(73) Assignee: Precision Automation, Inc., Vancouver, WA (US)

( * ) Notice: Subject to any disclaimer, the term of this patent is extended or adjusted under 35 U.S.C. 154(b) by 165 days.

(21) Appl. No.: 10/624,431

(22) Filed: Jul. 21, 2003

(65) Prior Publication Data

US 2005/0016943 A1 Jan. 27, 2005

(51) Int. Cl.
*A47F 7/00* (2006.01)

(52) U.S. Cl. ..... 211/70.6; 81/DIG. 5

(58) Field of Classification Search ..... 211/70.6, 211/DIG. 1, 87.01, 13.1; 81/DIG. 5, 119, 81/180.1, 121.1
See application file for complete search history.

(56) References Cited

U.S. PATENT DOCUMENTS 2,414,653 A * 1/1947 Lookholder ..... 335/285
2,733,113 A * 1/1956 Humbargar ..... 312/249.7
3,197,026 A * 7/1965 Gabryel ..... 206/471
3,749,233 A * 7/1973 McCormick, Jr. ..... 206/373
4,056,190 A 11/1977 Dix
4,405,108 A 9/1983 Muirhead
4,852,930 A 8/1989 Agee
5,152,441 A * 10/1992 Torena ..... 224/153
D387,202 S * 12/1997 Junkins ..... D3/315
5,725,096 A 3/1998 Winnard
5,772,047 A * 6/1998 Bostjancic ..... 211/13.1
5,853,092 A 12/1998 Goodman et al.
6,105,790 A * 8/2000 Parks ..... 211/42
6,393,950 B1 * 5/2002 Crosser ..... 81/119
6,827,275 B1 * 12/2004 Allen ..... 235/487
6,840,451 B1 * 1/2005 Allen ..... 235/462.09
2004/0256335 A1 * 12/2004 Sholem ..... 211/70.6

* cited by examiner

*Primary Examiner*—Sarah Purol
(74) *Attorney, Agent, or Firm*—Kolisch Hartwell, P.C.

(57) ABSTRACT

System, including methods, apparatus, components, and kits, for arrangement of tools in different marked configurations at a work station.

37 Claims, 2 Drawing Sheets

10
12
14
16
18
20
30
32
34
36
38
42
44
46
48
50
52
53
54
56
58
60
62
64
66
68
70
72

SYSTEM FOR INDUSTRIAL WORKSPACE ORGANIZATION

FIELD OF THE INVENTION

The invention relates to manufacturing processes and systems. More specifically, the invention relates to the reconfiguration and subsequent standardization of work station resources such as tools, jigs, component parts, and kitted assembly components, according to the principals of motion efficiency, process refinement and continuous improvement.

BACKGROUND AND SUMMARY OF THE INVENTION

Organization of tools is a primary determinant of the efficiency with which the tools may be used for various job functions. For efficient use, tools should be arranged to be visible, accessible, and consistently positioned. Such an arrangement may enable tools to be deployed and returned quickly, and inventoried readily to identify missing tools. Additional efficiency may be achieved by positioning tools according to how the tools are used. For example, frequently used tools may be placed closer to a worker than tools that are less frequently used, and tools commonly used together or used in a particular order may be placed near one another and/or in sequence.

A "shadow board" provides a system for tool organization. The shadow board may include a tool-holding structure, such as a peg board configured to hold tools adjacent a work site using tool-holding brackets. The storage position of each type of tool may be defined by a shape marked on the board near each bracket, such as a tool outline or "shadow" that is painted on the board. The shape provides a shape-based marker of the tool's storage position. In addition, the use of shapes minimizes the amount of mental processing necessary to pair tools with their storage positions. Accordingly, each tool may be returned easily to its predetermined storage position after use, and missing tools may be rapidly identified by visual inspection of the board for markers lacking a corresponding tool.

Despite its popularity, the shadow board may be too inflexible for some applications, such as lean manufacturing. In lean manufacturing (for example, the Toyota Production System), production is configured to be highly responsive to demand. To meet varying demands, each worker may be required to switch quickly and efficiently between different projects, often using different sets of tools. Accordingly, a fixed arrangement of tools defined by a shadow board may not be optimal for working on each of these different projects. Additionally, a fixed shadow board is not optimal for process refinement or continuous improvement, two important elements of lean manufacturing.

The invention provides a system, including method, apparatus, components, and kits, for arrangement of tools in different marked reconfigurable configurations at a work station.

DETAILED DESCRIPTION

The invention provides systems, methods, apparatus, components, and kits, for arranging tools and/or parts at a work station in marked configurations. The method may include selecting different marked configurations for the tools according to work to be performed on different projects. The apparatus, components, and kits may facilitate creation of a work station that is reconfigurable in one or more aspects to create different marked configurations of tools, based on the needs of a worker. Accordingly, the work station described herein may enable more flexible tool organization to increase productivity in a rapidly changing work environment.

Figures 1, 2, 3:
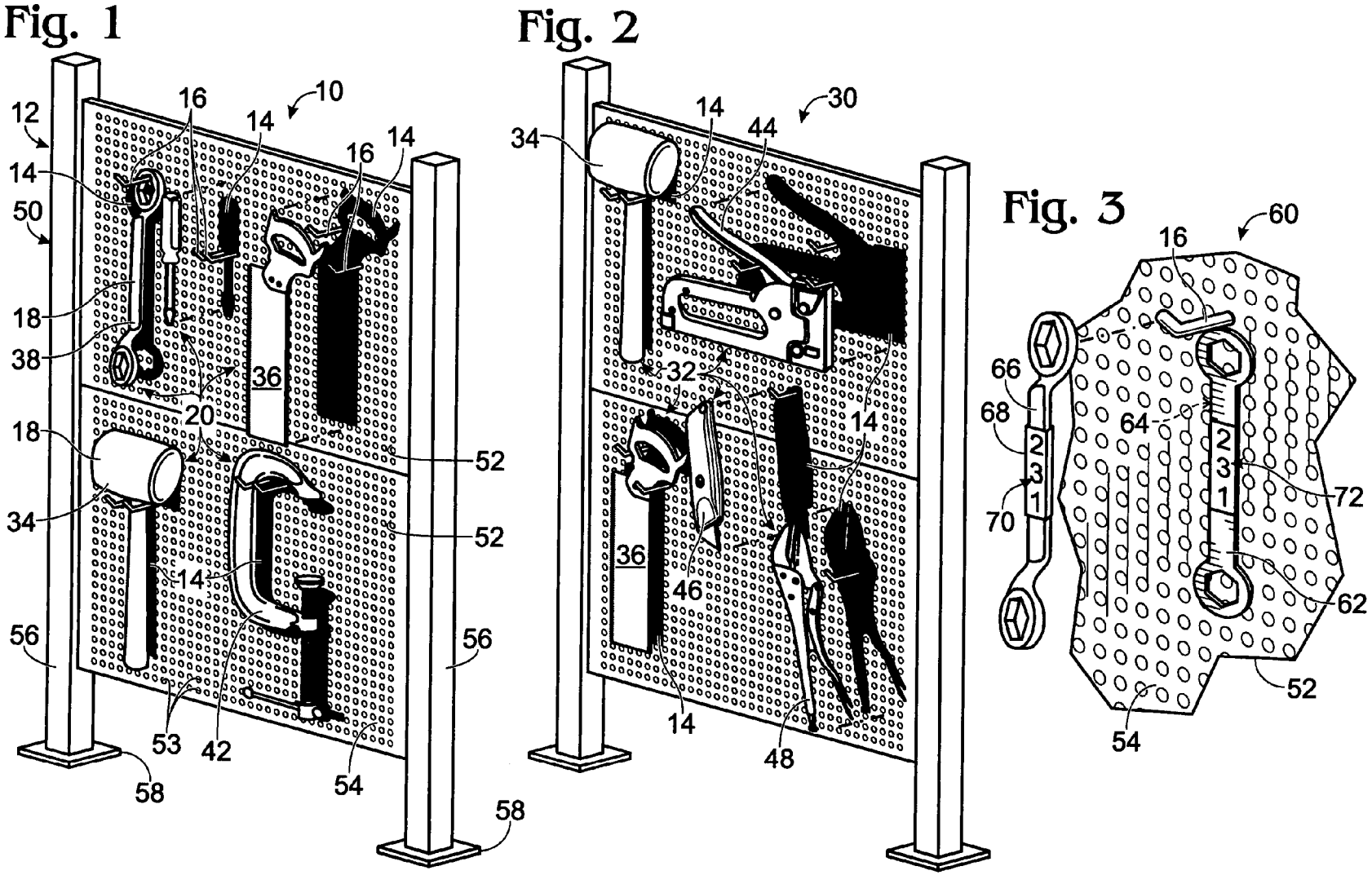
FIG. 1 is a view of an embodiment of a work station with a marked configuration of tools defined by tool markers, in accordance with aspects of the invention.
FIG. 2 is a of view of the work station of FIG. 1 after reconfiguration of the tool markers to define a different marked configuration of tools, in accordance with aspects of the invention.
FIG. 3 is a fragmentary view of a selected portion of a work station, illustrating a tool, a tool marker, and a tool label that labels the tool in correspondence with the tool marker, in accordance with aspects of the invention.

FIG. 1 shows an embodiment of a system or work station 10 that reconfigurably holds tools and/or parts in a marked configuration. Work station 10 may include a support structure 12 that supports and/or includes tool markers 14 and tool holders 16. Tool markers 14 may be configured to include shapes and/or indicia that correspond to tools 18 (and/or labels connected thereto). Accordingly, the tool markers may define a marked configuration 20 in which tools 18 may be disposed. Tool holders 16 may be placed adjacent the tool markers to hold tools 18 in the marked configuration defined by the tool markers. A subset of the tools are shown displaced from their storage positions in FIG. 1 (and in FIGS. 2–4), as indicated by dashed lines, to reveal the adjacent tool markers more fully.

The work station may be one of a set of two or more work stations at a manufacturing facility. Each work station may be configured for use by a different worker according to the needs of the worker, the tools used by that worker, etc. In some embodiments, the marked configuration of the work station may specifically identify the particular tools that belong to that particular work station.

A different marked configuration may be defined by reconfiguring the tool markers. For example, FIG. 2 shows a work station 30 with a modified configuration 32 of tools that is different from the marked configuration of work station 10. Modified configuration 32 may be produced by adding and/or removing one or more tools (and their corresponding tool markers). In the present illustration, a mallet 34 and a saw 36 are common to both configurations. A wrench 38, a screwdriver 40, and clamp 42 of marked configuration 20 are not present in modified configuration 32, and a stapler 44, a box cutter 46, and a vise grips 48 are not present in marked configuration 20. In some embodiments, different configurations may include all different tools (and tool markers) or may include all the same tools, but with one or more of the tools (and tool markers) positioned differently relative to support structure 12. Accordingly, modified configuration 32 may be defined by repositioning (disconnecting and reconnecting) tool markers, removing (disconnecting) tool markers, and/or connecting additional tool markers adjacent support structure 12. Based on how tools are supported by support structure 12, the tool holders may be repositioned, removed, and/or added in correspondence with tool markers 14, or may be left unchanged.

A marked configuration may be defined by the positions and identities of a set of tool markers. The positions may be relative to one another and/or relative to the support structure. Accordingly, changing the positions of the tool markers changes the marked configuration. The identities of the tool markers are based on shapes and/or indicia that the tool markers include, as described in more detail below. Accordingly, changing the identities of the tool markers, without substantially changing their relative positions, also may change the marked configuration.

Tool stations as described herein may be suitable for performing methods of arranging tools for different projects. A set of tools and a configuration of the set of tools may be selected according to work to be performed on a project. The set of tools may include only tools to be used for the project, or may include additional tools for other purposes, such as maintenance or repair. The configuration may be selected to optimize use of the tools in performing the work on the project. Accordingly, the configuration may consider frequency of tool use, size/weight of tools, order of tool use, combinations of tools used together, position of the worker during/after use of each tool, etc. In some embodiments, the configuration may be selected from among potential configurations, based on how efficiently the work is expected to be performed with the selected configuration relative to the other potential configurations. Efficiency may be measured according to time or human effort expended by performing the work with each configuration, level of worker safety, amount of wear on the tools, etc.

The method may include steps of marking, placing, and performing. The step of marking may mark the selected configuration with a tool marker corresponding to each tool according to the configuration. Marking the configuration may include connecting preformed tool markers to a support structure. In addition, marking may include fabricating the tool markers before connecting the tool markers. The step of placing may place the tools in the selected configuration. Placing may include arranging tool holders according to the selected configuration, so that a suitable tool holder (for each tool marked) is disposed adjacent each tool marker. The step of performing may perform work on the project, generally with tools that were placed in the configuration. The tools may be removed from the configuration in the order they are to be used, or in any other suitable order. After use, the tools may be returned to the configuration after each tool is used, after all tools are used, or, in some embodiments, may not be returned to the configuration. Any suitable work may be performed on any suitable project, including manufacturing, assembling, testing or prototyping a product at a manufacturing facility, working on a project at home, and/or servicing or repairing an article, among others.

The method also may include repeating the steps of selecting, marking, placing, and performing, as described above, but for a different project. Repeating may include adjusting the shape and/or area of a support structure, for example, to hold more or fewer tools, or to accommodate different sizes of tools or a different position of the tools relative to the work being performed. The repeated step of selecting may select the same or a different set of tools, based on the tools needed for the different project, and selects a different configuration of tools. The repeated step of selecting may include fabricating one or more new tool markers. The repeated step of marking may include disconnecting some or all of the tool markers from a support structure. If the disconnected tool markers are needed in the different configuration, the disconnected tool markers may be reconnected at different positions. Alternatively, or in addition, additional tool markers may be connected to the support structure.

Support structure 12 is any structure configured to support and/or include tool markers 14 and tool holders 16, and to support tools 18. Support structure 12 may include a frame 50 connected to one or more support elements, such as panels 52 (see FIG. 1). The support elements and/or the frame may define a surface 54, adjacent which the tool markers, tool holders, and tools are disposed. The surface may be at least substantially vertical, horizontal, and/or inclined, and may be generally planar, curved, angled, and/or the like.

The frame may include any structure that positions panels and/or surface 54 in space. The frame may be fixed or portable. Exemplary fixed frames may include a portion of a building, such as a wall, floor, beam, stud, or post, and are thus not movable readily. Exemplary portable frames may be disposed at a plurality of different positions relative to the inside or outside of a building, but may be reversibly attachable to structural portions of the building. In some embodiments, the frame may include two or more posts 56. The posts may be freestanding, for example, having a supporting base 58. Freestanding posts may be mobile through the addition of wheels, casters or other device. The posts may be connected to one another through panels 52 or may include cross-frame components that extend between the posts. Alternatively, or in addition, the posts may be configured to be connected to a floor, wall, and/or ceiling of a building.

The size of the frame may be adjustable. For example, two posts may be spaced differently in accordance with different widths of panels, and/or three or more posts may be arrayed to position two or more columns of panels, among others. In addition, posts may have adjustable heights, or posts of different heights may be used.

The support elements or panels 52 may have any suitable structure that allows connection to frame 50, tool markers 14, and tool holders 16.In some embodiments, the support elements may be rectangular panels. The rectangular panels may be square and/or may have holes 53 (recesses or through-holes) configured to receive a proximal portion of each tool holder and/or a portion of each tool marker. The holes may have any suitable size, shape, configuration, and density, for example, an orthogonal or other regular array of through-holes. The support elements may be generally planar. The support elements may have a height that is greater than half the height of the frame, for example, so that one support element is supported between posts 56. Alternatively, some or all of the support elements may have a height less than half the height of the frame, so that two or more support elements may be held between posts 56, for example, to form a column of support elements. The support elements may be connected to frame 50 by any suitable mechanism, such as brackets, fasteners, etc.

The support elements may be formed of any suitable material. Exemplary materials may include, but are not limited to, metal, wood, plastic, ceramic, or a combination thereof. In some embodiments, at least a portion of each support element may be magnetic (that is, magnetized or attracted to a magnet). The support element may include any suitable indicia, including a color, one or more symbols (such as letters or numbers), a bar code, etc. A surface of a support element may be writable with a nonpermanent marker and erasable (such as a white board or black board), may include the tool markers, and/or may include a VELCRO component, as described further below.

The tool holders may be any devices configured to support one or more tools adjacent the support structure. The tool holders may be configured to hold a specific tool or type of tool or may be generic to holding different types of tools. The tool holders may be fixed or may be movable relative to the support structure, to allow the tool holders to be removed or repositioned. Fixed tool holders may be formed as part of the support structure or may be attached permanently after the support structure is formed. Movable tool holders may be connected with fasteners, by magnetic attraction, by VELCRO, with an adhesive, by mating, etc. Exemplary tool holders may include pegs, hooks, recesses, bins, shelves, brackets, caddies, arms, and/or the like. In some embodiments, the tool holders may be received by holes 53 defined by the support structure (see FIG. 1).

The tools may be any devices configured to perform or facilitate performance of work on a project. The tools may have any suitable level of complexity and user control. For example, some or all of the tools may be relatively simple, hand-driven tools, as depicted in FIGS. 1 and 2. Alternatively, the tools may be power tools, that is, tools powered by an electrical power source, compressed gas, or chemical fuel, among others. In some embodiments, one or more of the tools may be controlled digitally. Accordingly, the tools may be deployed from the work station by hand, by user input (for example, by pressing a button), and/or automatically (for example, according to digital instructions).

FIG. 3 shows a portion of a work station 60. Work station 60 includes an embodiment of a tool marker 62 marking a tool position 64 for a tool (wrench 66), below tool holder 16 and adjacent surface 54. The tool may include a label 68 connected to the tool. Tool label 68 may include label indicia 70 ("231") that correspond to marker indicia 72 included on tool marker 62.

The tool marker may be any component configured to mark a position for a particular tool (and/or a connected tool label) in a tool and may be reversibly affixable. Each tool marker may be configured to correspond to a particular tool (or tool label) using one or more features included in the tool marker. The feature(s) may be visible and/or machine readable.

The feature may be a shape or indicia defined by and/or included in the tool marker. The shape may correspond to a silhouette of the tool to which the marker corresponds and identifies. The silhouette may be an entire silhouette of the tool, or a silhouette of a portion of the tool. The shape may correspond to an accurate or abstract silhouette, and may be a filled shape, an outline or an image of the actual item, among others. In addition, the silhouette (and thus the shape defined by the tool marker) may have any suitable size relative to the tool or the tool portion, including substantially the same size, substantially larger (magnified), or substantially smaller. In some embodiments, the tool marker may define a shape that is substantially unrelated to the tool silhouette, such as a circle, rectangle, etc., which also may be included in a corresponding tool label to be paired with the tool marker. The tool marker may define the shape with any suitable region of the tool marker, including an outer edge or perimeter (or a portion thereof), an inner edge (or portion thereof), a surface (such as by a surface contour or surface contrast, among others), and/or an internal region (such as with a partially transparent tool marker). The indicia may be any marking(s) included in a tool marker. The marking(s) may be a symbol(s) (such as a number, a letter, a word, etc.), a color(s), a code(s) (such as a barcode or other machine-readable code), and/or the like (or a combination of the above).

Each tool marker may be connected to the support structure of the work station by any suitable mechanism. Connection to the support structure may be according to the composition/structure of the tool marker and the support structure. Accordingly, connection may be through magnetic attraction, electrostatic interactions, surface tension, chemical bonding, generally complementary physical structures, and/or fasteners/brackets, among others. The tool marker may be configured to stick to the surface of the work station upon contact. For example, the tool markers and at least a portion of the support structure (such as panel 52) may be formed of a magnetic material. Alternatively, the tool markers may include a tacky material that sticks to the support structure (such as an adhesive or tape), or the tool markers and support structure may include VELCRO structures that are functionally complementary. Complementary physical structures may include protrusions on the tool markers (or the support structure) configured to be received by holes, that is, recesses or openings, of the support structure (or tool markers). Alternatively, connection may be through a tool holder that connects the tool marker to the support structure. For example, the holder may be tool holder 16 extending through an aperture of the tool marker and/or may be one or more marker holders, fasteners, or brackets that connect a tool marker to the support structure.

Tool markers may be configured to be fixed or repositionable. Fixed tool markers are configured so that they cannot be moved relative to the support structure without damaging the tool marker or the support structure. Exemplary fixed tool markers may include tool markers that are formed as a layer of optically-contrasting material applied to a surface of the support structure by painting, or tool markers that are connected with a substantially permanent adhesive, among others. Repositionable tool markers may be connected to the support structure, and then disconnected and reconnected at the same or a different position on the support structure. Exemplary repositionable tool markers may be connected magnetically, or using tool holders, a weak adhesive, VELCRO, etc. In some embodiments, the repositionable tool markers may be moved between positions on the support structure without disconnecting the tool markers.

Tool markers may be formed of any suitable material and by any suitable process. Exemplary materials may include metal, plastic, paper, wood, rubber, ceramic, paint, or a combination thereof, among others. In some embodiments, the tool markers may be formed from a sheet of a suitable precursor material, such as a magnetic sheet, an adhesive-backed sheet, or a sheet of paper, among others. Processes for forming the tool markers may include cutting tool markers from the sheet, for example, as shapes corresponding to tool silhouettes. Alternatively, or in addition, cutting may form an aperture in each tool marker, with the apertures having shapes corresponding to tool silhouettes. In some embodiments, the sheets may be printed with indicia and/or shapes, and then the tool markers cut from the sheets. Alternatively, the tool markers may be printed with indicia or shapes after the tool markers have been cut. In other embodiments, indicia and/or shapes may be applied to the tool markers as separate layers, for example, as adhesive marker labels, before or after the tool markers are cut. In some embodiments, the tool markers may be produced by molding or casting.

Tool markers may be formed as separate components or two or more tool markers may remain connected after their formation. Accordingly, two or more tool markers may be formed on a sheet of material and then used as a unit. In some embodiments, a configuration of tool markers may be printed or otherwise defined on a sheet of material (such as by cutting out apertures) and then used directly by connection to a support structure without separating the tool markers from one another.

Tool label 68 may have any suitable structure and may include any suitable shapes/indicia. The tool label may be formed of plastic, paper, metal, and/or the like, and may be connected to the tool by any suitable method, such as by shrink-wrapping, as an adhesive label, with tape, magnetically, and/or the like. The tool label may correspond to the tool to which the tool label is connected and/or to the tool marker with which the tool label is to be paired. Accordingly, the tool label may define and/or include any visible or machine-readable shape and/or indicia, as described above for the tool markers. For example, the tool label may include a color, one or more symbols (numbers, letters, words, etc.), and/or a shape (such as the silhouette of the tool and/or the silhouette presented by the tool marker), among others. Thus, the tool label may correspond to one or more visible features of the tool marker, which may be different than a feature of the tool marker used to identify the tool itself. The use of tool labels may, for example, enable similar-appearing tools to be assigned to different work stations or to be assigned to different positions of the same work station. Alternatively, or in addition, such labels may facilitate tool inventory for an entire facility, such as with barcodes or other machine-readable formats. In some embodiments, the tool labels may correspond to a particular work station rather than a particular tool marker. For example, each tool of a work station may be connected to a tool label bearing similar or identical indicia.

Work station examples are described below. Work station reconfiguration may include attachment arms, parts bins, pneumatic service, electrical service, lighting, computer equipment and other options. The system may be modular to meet the revised need and provides for visual standardization after revision.

Figure 4:
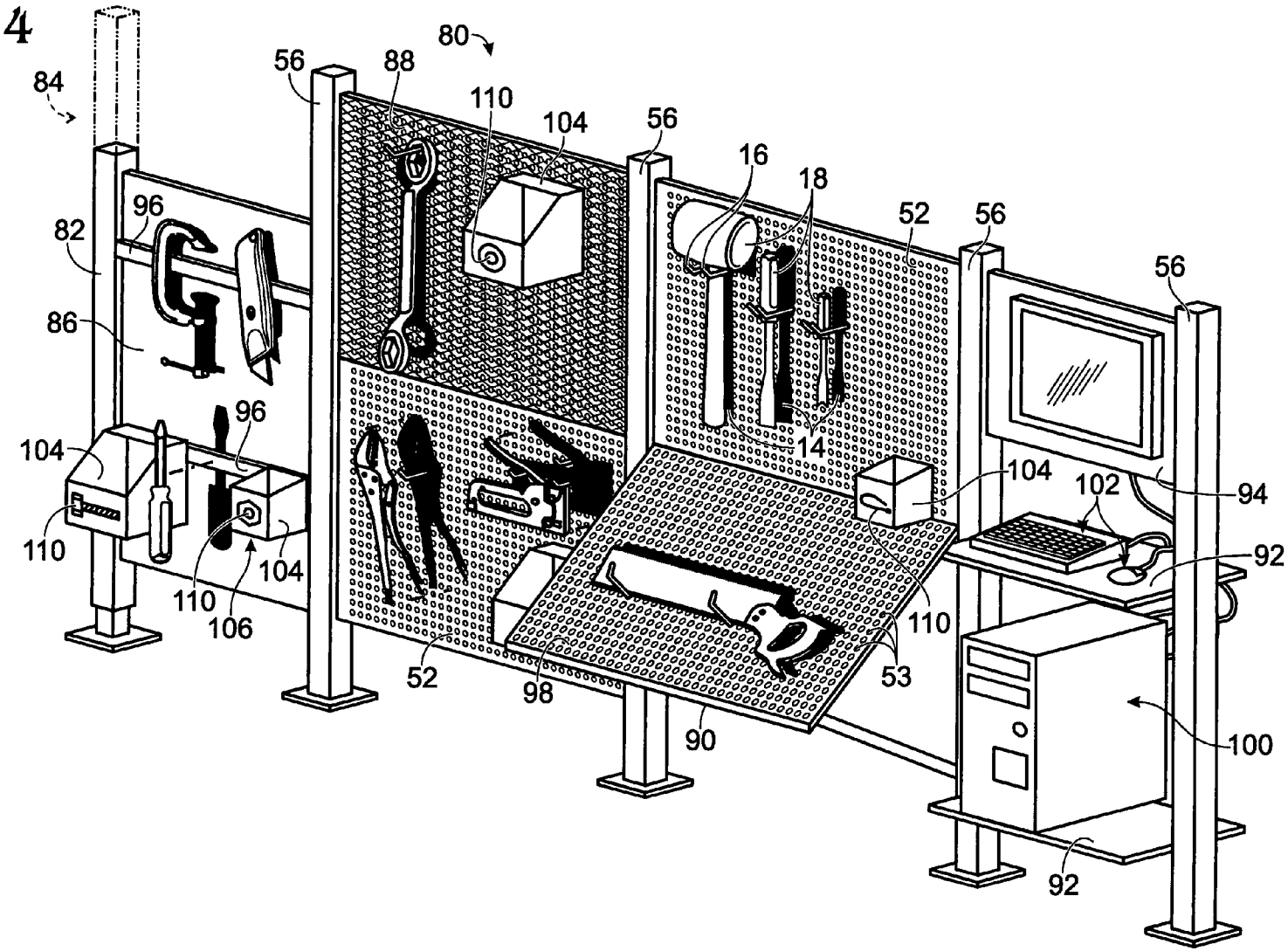
FIG. 4 is a view of the work station of FIG. 1 after reconfiguration to expand a support area of the work station and to change the marked configuration of tools, in accordance with aspects of the invention.

FIG. 4 shows an expanded work station 80 formed by reconfiguring work station 10 of FIG. 1. Work station 80 may include additional posts 56 including adjustable post 82, which may telescope to different heights, shown at 84.

Additional panels may be connected to posts 56 or exchanged for one or both of panels 52, such as solid panel 86 (no holes), colored panel 88, adjustable panel 90, shelf panels 92, and monitor panel 94. Solid panel 86 may include connected magnetic strips 96 for holding tools or article holders. Colored panel(s) 88 may provide an additional level of organization for the work station, for example, to group tools according to kind, function, sequence of use, etc. In some embodiments, tool label 68 (see FIG. 3) may include a color (or other indicia) that corresponds to the color (or other indicia) of a panel adjacent which the corresponding tool is to be placed. Adjustable panel 90 may define an movable surface 98 that may be disposed at one of two or more selected angles. Shelf panels 92 may define substantially horizontal surfaces to provide, for example, a work table or a storage space for larger tools or equipment, such as computer 100 and keyboard/mouse 102.

Work station 80 also may include article holders 104. The article holders may hold tools, or may hold any suitable parts incorporated into a product during its manufacture. Article holders 104 may be configured as bins, baskets, or other containers. The article holders may be connected magnetically (shown at 106) or by mating between pegs, hooks, or other protrusion of the article holders and holes 53 of the panels. Each article holder may include an article marker 110 connected to the article holder or to a panel, adjacent the article holder.

The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. The subject matter of the inventions includes all novel and nonobvious combinations and subcombinations of the various elements, features, functions, and/or properties disclosed herein. The following claims particularly point out certain combinations and subcombinations regarded as novel and nonobvious. Inventions embodied in other combinations and subcombinations of features, functions, elements, and/or properties may be claimed in applications claiming priority from this or a related application. Such claims, whether directed to a different invention or to the same invention, and whether broader, narrower, equal, or different in scope to the original claims, also are regarded as included within the subject matter of the inventions of the present disclosure.

I claim:

1. A system for organizing tools comprising a manufacturing station having a surface or mechanism for supporting tools, a set of tool-identifying markers corresponding to a set of tools selected for a particular manufacturing procedure, the markers being reversibly affixed to the surface in a manner allowing ongoing refinement of the configuration to maximize efficiency of the manufacturing procedure, wherein the markers are affixed to the surface magnetically.

2. The system of claim 1, wherein each marker has a shape resembling the shape of a corresponding tool.

3. The system of claim 1, wherein the surface is substantially vertical.

4. The system of claim 1 further comprising tool marks configured for affixing to the set of tools, each tool mark indicating a connection between the respective tool and the manufacturing station or a particular location on the surface of the station.

5. The system of claim 1 wherein the relative positions of tools in the arrangement are determined at least partially by a sequence of steps in the procedure.

6. The system of claim 1 wherein the relative positions of tools in the arrangement are determined at least partially by the frequency of using the tools in the procedure.

7. A method of carrying out a manufacturing procedure comprising selecting a procedure including a first sequence of steps for manufacturing a first product at a work station, selecting a first set of tools for carrying out the first sequence of steps, engineering a first positional arrangement for the first set of tools to be held on a surface adjacent the work station, the arrangement being configured to maximize execution efficiency of the first sequence of steps by designating a site on the surface for each tool where the tool resides when not being used, obtaining a first set of tool-identifying markers, each of the markers having a mechanism for being reversibly located adjacent the site for its respective tool, attaching the tool-identifying markers to the surface according to the first positional arrangement, and mounting the first set of tools at their respective sites.

8. The method of claim 7 further comprising selecting a second product to manufacture at the work station, selecting a procedure including a second sequence of steps for manufacturing the second product, selecting a second set of tools for carrying out the second sequence of steps, engineering a second positional arrangement for the second set of tools to be held on the surface adjacent the work station, the arrangement being configured to maximize execution efficiency of the second sequence of steps by designating a site on the surface for each tool in the second set where the tool resides when not being used, obtaining a second set of tool-identifying markers for the second set of tools, each of the markers having a mechanism for being reversibly located adjacent the respective site on the surface, removing at least some of the first set of tool-identifying markers from the surface, attaching the second set of tool-identifying markers to the surface according to the second positional arrangement, and mounting the second set of tools at their respective sites on the surface.

9. The method of claim 7, further comprising replacing the second set of tool-identifying markers with the first set of tool-identifying markers according to the first positional arrangement.

10. The method of claim 7, wherein the tool-identifying markers have shapes that resemble the tool they identify.

11. The method of claim 7, wherein the tool-identifying markers are magnetized.

12. The method of claim 7, wherein the product is a component of a second product.

13. The method of claim 7, wherein at least a portion of the surface is substantially vertical.

14. The method of claim 7, wherein the surface is comprised of multiple interchangeable panels.

15. The method of claim 7, further comprising connecting a computer to the work station.

16. The method of claim 7, further comprising connecting a display screen to the work station.

17. The method of claim 7, further comprising providing at least one electrical outlet at the work station, the position of the outlet being moveable to accommodate different positional arrangements of tools for different product manufacturing.

18. The method of claim 7, further comprising marking the tools so they are associatable with their tool-identifying markers.

19. The method of claim 7, further comprising marking the tools so they are associatable with a particular work station.

20. A system for arrangement of tools adjacent a support structure for holding tools, comprising:

a set of labels configured to be connected to the tools; and a plurality of tool markers disposed adjacent the support structure to mark a selected configuration of the labels and their respective tools, each tool marker corresponding visibly to a different label of the set and indicating a position on the support structure where the respective tool resides when not being used, wherein the tool markers are configured to be reversibly repositionable with respect to the support structure to mark different selected configurations of the labels and their connected tools.

21. The work station of claim 20, the tools defining silhouettes, wherein the tool markers include shapes corresponding to the silhouettes.

22. The work station of claim 20, wherein each label and each tool marker have indicia, and wherein the indicia of each label corresponds to the indicia of a different tool marker.

23. A work station for arrangement of tools, comprising:

a support structure including a plurality of tool holders and a surface defining an area, the support structure being reconfigurable to increase and decrease the area; and a plurality of tool markers configured to be connected to the support structure adjacent the tool holders to specify a selected configuration of tools, the tool markers corresponding visibly to different tools and defining a position in the selected configuration for each different tool, wherein the tool markers are configured to be reversibly repositionable on the support structure, thereby enabling the selected arrangement to be reconfigured.

24. The work station of claim 23, wherein the support structure includes a portable frame and a plurality of panels configured to be connected to the frame, and wherein the frame is adjustable to enable fewer or more of the panels to be connected to the frame.

25. The work station of claim 23, wherein the tool markers are configured to stick to the surface upon contact.

26. The work station of claim 23, the support structure including at least one support element that at least substantially defines the surface, the support element including a plurality of holes, wherein the tool holders are configured to be connected via a selected subset of the holes to position the tool holders in correspondence with the selected configuration.

27. The work station of claim 23, further comprising at least one label configured to be connected to at least one of the different tools, the label including indicia corresponding visibly to a tool marker for the at least one tool.

28. A method of arranging tools for different projects, comprising:

selecting a set of tools for performing a project;

designing a positional configuration for arranging the tools adjacent a surface;

marking the configuration adjacent the surface with a reversibly repositionable tool marker corresponding to each tool according to the configuration;

placing the tools in the positional configuration adjacent the surface;

performing the work on the project; and repeating the steps of selecting, marking, placing, and performing for a different project and a different configuration.

29. The method of claim 28, wherein the step of selecting and the step of repeating the step of selecting select different sets of tools.

30. The method of claim 28, wherein the step of repeating the step of marking includes a step of fabricating one or more additional tool markers.

31. The method of claim 28, wherein the step of marking includes a step of fabricating the tool markers and a step of placing the tool markers after the step of fabricating.

32. The method of claim 28, wherein the step of marking is performed by connecting the tool markers to a support structure for holding tools, and wherein repeating the step of marking includes disconnecting one or more of the tool markers from the support structure.

33. The method of claim 32, wherein repeating the step 6f marking includes reconnecting at least one of the one or more tools markers after the step of disconnecting.

34. The method of claim 28, wherein the step of selecting a configuration includes selecting the configuration from among a plurality of potential configurations according to an expected reduction in at least one of time and effort expended by the step of performing the work with the selected configuration relative to the other potential configurations.

35. The method of claim 28, wherein the step of selecting selects tool markers defining shapes corresponding to silhouettes of the tools.

36. The method of claim 28, wherein the steps of marking and placing are performed adjacent a surface having properties corresponding to length, width, area, position, color, composition, texture, and distribution of holes, and wherein the step of repeating include changing at least one of the properties before repeating the step of performing.

37. A system for organizing tools comprising a manufacturing station having a surface or mechanism for supporting tools, a set of tool-identifying markers corresponding to a set of tools selected for a particular manufacturing procedure, the markers being reversibly affixed to the surface in a manner allowing ongoing refinement of the configuration to maximize efficiency of the manufacturing procedure, and tool marks configured for affixing to the set of tools, each tool mark indicating a connection between the respective tool and the manufacturing station or a particular location on the surface of the station.

* * * * *